US010159996B2

(12) United States Patent
McAndrew et al.

(10) Patent No.: US 10,159,996 B2
(45) Date of Patent: Dec. 25, 2018

(54) SYSTEM FOR DISPENSING MULTIPLE COMPONENT CHEMICAL SPRAYS

(71) Applicant: Akurate Dynamics LLC, Houston, TX (US)

(72) Inventors: Charles I. McAndrew, Magnolia, TX (US); Trey D. Cook, Houston, TX (US); Travis T. Brandt, Houston, TX (US); R. Ryan Snider, Cypress, TX (US); Kenneth D. Swatzel, Montgomery, TX (US); Edward R. Brewer, Houston, TX (US)

(73) Assignee: Akurate Dynamics LLC, Houston, TX (US)

( * ) Notice: Subject to any disclaimer, the term of this patent is extended or adjusted under 35 U.S.C. 154(b) by 0 days.

(21) Appl. No.: 15/866,691

(22) Filed: Jan. 10, 2018

(65) Prior Publication Data

US 2018/0126398 A1 May 10, 2018

Related U.S. Application Data

(63) Continuation of application No. 14/854,092, filed on Sep. 15, 2015, now Pat. No. 9,895,708.
(Continued)

(51) Int. Cl.
*B05B 12/14* (2006.01)
*B05B 9/00* (2006.01)
(Continued)

(52) U.S. Cl.
CPC ..... *B05B 9/002* (2013.01); *B05B 12/10* (2013.01); *B05B 12/1418* (2013.01); *B05B 7/1693* (2013.01)

(58) Field of Classification Search
CPC B05B 9/002; B05B 9/03; B05B 12/10; B05B 12/1418; B05B 7/1693;
(Continued)

(56) References Cited

U.S. PATENT DOCUMENTS 3,232,585 A 5/1964 Garbinaro et al.
3,880,228 A 4/1975 Houk et al.
(Continued)

FOREIGN PATENT DOCUMENTS

WO 2014099796 A1 6/2014
WO 2017160289 A1 9/2017

*Primary Examiner* — Christopher Kim
*Assistant Examiner* — Juan C Barrera
(74) *Attorney, Agent, or Firm* — Blank Rome LLP

(57) ABSTRACT

A system for dispensing a plurality of chemicals includes a respective storage tank for each chemical. A respective metering, rotary positive displacement pump is in hydraulic communication at an inlet thereof with an outlet of each tank. An outlet of each pump is connected to a respective discharge hose. At least one heater is in thermal contact with each discharge hose. At least one temperature sensor is provided for measuring a temperature of each chemical in each respective discharge hose. A pressure sensor is provided for measuring pressure at an inlet end and at an outlet end of each discharge hose. A processor is in signal communication with each temperature sensor, each pressure sensor, a metering signal output of each pump and in control communication with each heater. The processor is programmed to operate each heater to maintain a temperature of each chemical such that a selected difference between pressure is measured between the inlet end and the discharge end of each discharge hose when each respective chemical is moved therethrough.

20 Claims, 1 Drawing Sheet

Related U.S. Application Data

(60) Provisional application No. 62/165,225, filed on May 22, 2015, provisional application No. 62/066,028, filed on Oct. 20, 2014.

(51) Int. Cl.
*B05B 12/10* (2006.01)
*B05B 7/16* (2006.01)

(58) Field of Classification Search
CPC .. B05B 7/00–7/32; B05B 9/00–9/0894; B05B 12/00–12/40; B05B 11/0078; B05B 11/0081; B05B 7/2472; B05B 7/0408; A01M 7/0089
USPC ..... 239/130, 131, 135, 139, 13, 67, 68, 69, 239/128, 407, 408, 417.5, 423, 303, 304, 239/308, 329, 331, 332, 333; 222/145.6, 222/145.7, 145.8
See application file for complete search history.

(56) References Cited

U.S. PATENT DOCUMENTS 3,921,901 A 11/1975 Woodman
4,019,653 A 4/1977 Scherer et al.
4,113,182 A 9/1978 Brago
4,341,327 A 7/1982 Zeitz
4,493,286 A 1/1985 Carson
4,509,903 A 4/1985 Fram
4,562,088 A 12/1985 Navarro
4,789,100 A 12/1988 Senf
4,809,909 A * 3/1989 Kukesh ..... B05B 7/24 239/1
4,928,880 A 5/1990 Prus et al.
4,994,984 A 2/1991 Massimo
5,146,949 A 9/1992 Maugans
5,388,761 A 2/1995 Langeman
5,634,779 A 6/1997 Eysymontt
6,315,161 B1 11/2001 Bezaire et al.
6,685,054 B2 2/2004 Kameyama
7,350,672 B1 4/2008 Gerich
8,251,603 B2 8/2012 Kott et al.
9,156,046 B2 10/2015 Jerdee
9,174,234 B2 11/2015 Snowwhite et al.
2003/0158630 A1* 8/2003 Pham ..... G05D 11/132 700/285
2007/0045445 A1 3/2007 Hackel et al.
2010/0111708 A1* 5/2010 Seto ..... F04B 43/046 417/44.1
2011/0031270 A1 2/2011 Choiniere et al.
2012/0282121 A1 11/2012 Kieffer et al.
2014/0084025 A1* 3/2014 Tix ..... F04B 17/03 222/135
2014/0166775 A1 6/2014 Courier
2014/0209630 A1* 7/2014 O'Leary ..... B05C 17/00516 222/23
2014/0209703 A1 7/2014 Jerdee et al.

* cited by examiner

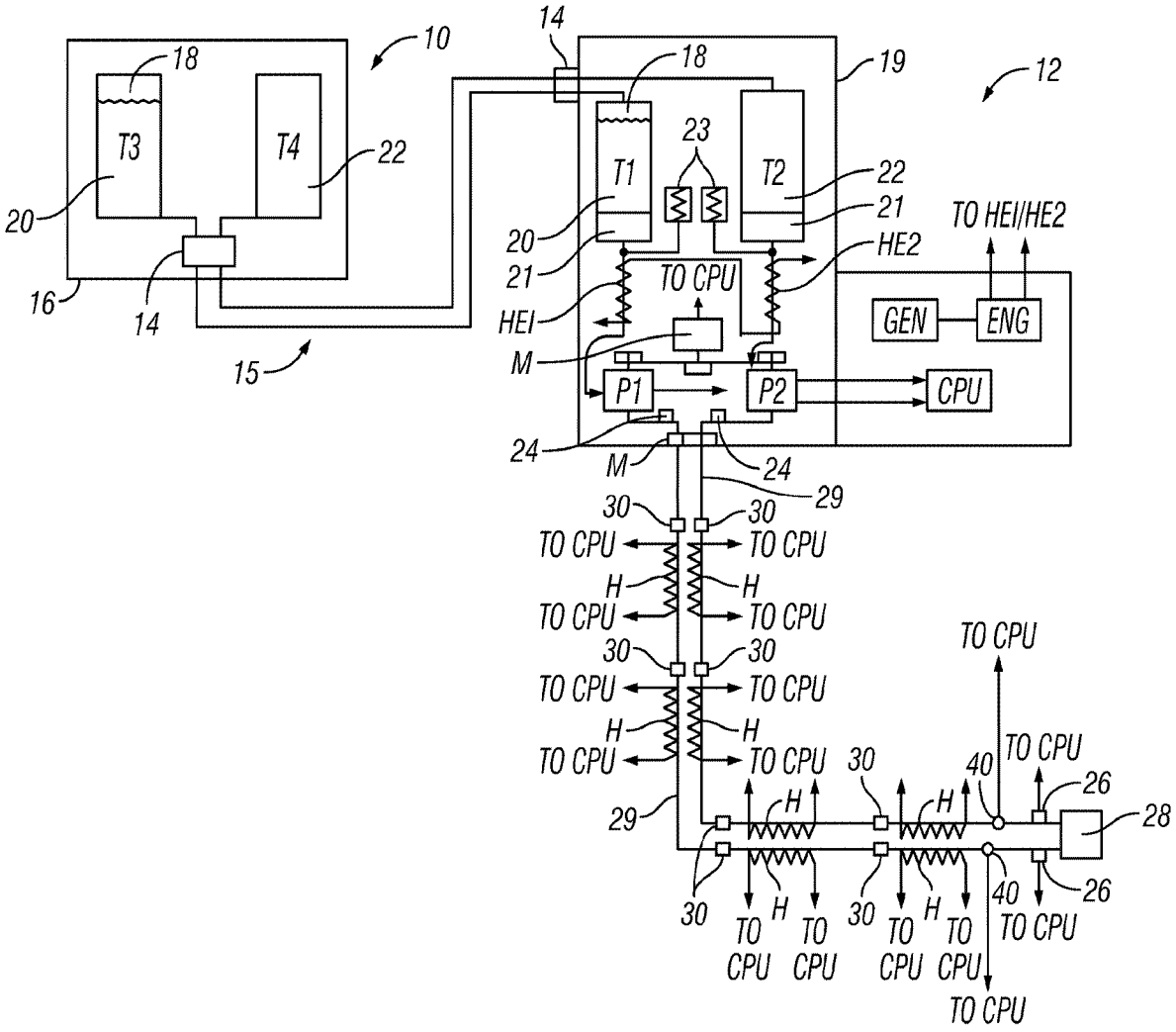
12
19
22
21
HE2
T2
23
18
T1
20
21
HEI
14
10
22
T4
18
T3
20
16
14
15
TO HEI/HE2
ENG
GEN
CPU
TO CPU
P2
P1
M
24
29
30
H
TO CPU
28
26
40
TO CPU

SYSTEM FOR DISPENSING MULTIPLE COMPONENT CHEMICAL SPRAYS

CROSS-REFERENCE TO RELATED APPLICATIONS

This application is a continuation of U.S. patent application Ser. No. 14/854,092 filed on Sep. 15, 2015, and now issued as U.S. Pat. No. 9,895,708 which claims the benefit of U.S. Provisional Application No. 62/066,028, filed on Oct. 20, 2014, and U.S. Provisional Application No. 62/165,225, filed on May 22, 2015, the contents of which are hereby incorporated by reference in their entireties.

FEDERALLY SPONSORED RESEARCH OR DEVELOPMENT

Not Applicable

BACKGROUND

This disclosure is related to the field of systems for spray application of multiple component liquid compounds, wherein the multiple components are mixed at the point of spray application. More specifically, the disclosure relates to systems for such spray application which require very precise control over the volume and/or mass flow rate of each of a plurality of liquid chemicals when applied by a spray gun.

Spraying systems known in the art for application of multiple component liquid chemicals known in the art include reciprocating-type pumps having inlets disposed in standard sized containers, e.g., 55 gallon drums. The reciprocating pumps are selectively actuated to move each of a plurality of liquid chemicals through respective hoses to a spray application "gun" or sprayer, wherein the plurality of liquid chemicals is mixed at the point of application of the spray discharged from the sprayer. Discharge from the pumps is conducted to the spray gun through respective hoses. Such systems may or may not include a separate hose for introduction of gas under pressure, such as air, to help atomize the liquid chemicals for spray application. Examples of such multiple component liquid chemicals include thermal insulation which may consist of two liquid components to be mixed at the point of application. The two liquid components react at the point of application to form a foam, which eventually cures into finished insulation.

Manufacturers of multiple component liquid chemical compounds specify the volume and/or mass of each component that is required to be dispensed so that the correct chemical reaction or other physical process (e.g., evaporation) takes place at the point of application. Using systems known in the art for spray applying multiple component chemicals may not have sufficient accuracy in determining the volume and/or mass flow rate of each component chemical to dispense the manufacturer-specified amount of each component chemical when the spray is actually applied.

Systems known in the art may also allow environmental and personnel hazards resulting from use of chemical withdrawn from open containers, and from the users being required to transfer the pump inlets from empty chemical containers to full ones when containers are emptied. The former limitation of systems known in the art results from the temperature of the sprayed component chemicals being uncontrolled, and from lack of accuracy in measurement of volume and/or mass of each liquid component actually moved by reciprocating-type liquid pumps. A further environmental exposure may result from the need to dispose of empty liquid containers. Some liquid chemicals may be reactive with ambient air, and as a result using containers that are exposed to the air when opened may enable degrading of such reactive chemicals.

BRIEF DESCRIPTION OF THE DRAWING(S)

FIG. 1 shows an example embodiment of a system according to the present disclosure.

DETAILED DESCRIPTION

FIG. 1 shows an example embodiment of a multiple component spray applicator system according to the present disclosure. The system may include a bulk storage filling unit 10 and a chemical dispensing unit 12. The bulk storage filling unit 10 and the chemical dispensing unit 12 may each be disposed in a respective protective housing 16, 19. The protective housings 16, 19 may each be mounted to a separate road-mobile platform such as a trailer or truck (not shown).

The bulk storage filling unit 10 may include an individual chemical storage tank, shown at T3, T4, for each of a plurality of separate chemicals to be dispensed by the chemical dispensing unit 12. In the present example embodiment, there are two chemical storage tanks T3 and T4, however the number of such tanks is not a limitation on the scope of the present disclosure. For chemicals that may be reactive with ambient air, one or more of the chemical storage tanks, T3 in the present example embodiment, may include a non-reactive gas 18 disposed above a first liquid chemical 20 disposed in the chemical storage tank T3. An example gas is nitrogen, although the composition of the non-reactive gas and its pressure are not to be construed as limitations on the scope of the present disclosure. A second liquid chemical 22 may be disposed in the other chemical storage tank T4. The protective housing 16 may include a dry-connect valve 14 for connection of filling hoses 15 to a corresponding dry-connect valve in the housing 19 of the chemical dispensing unit 12. The chemical storage tanks T3 and T4 may be of a type that may be filled by the provider of the liquid chemicals in a manner that substantially eliminates exposure of the liquid chemicals to the atmosphere. The chemical storage tanks T3 and T4 may also be resistant to damage in the event of a vehicle collision. In some embodiments, the chemical storage tanks T3, T4 may be 660 gallon, sealed, certified road hazard resistant tanks The chemical dispensing 12 unit may include a separate supply tank T1, T2 for each of the separate liquid chemicals 20, 22 to be applied by spraying. As explained above, the protective housing 19 of the chemical dispensing unit may include a dry-connect valve 14 for coupling the filling hoses 15 thereto when it is necessary to refill the supply tanks T1, T2. As is the case for the bulk storage filling unit 10, any one or more of the supply tanks T1, T2 in the chemical dispensing unit 12 may include a non-reactive gas 18, e.g., nitrogen, for chemicals that may be reactive with ambient air. The interior of the chemical dispensing unit protective housing 19 may be thermally insulated so that the temperature inside the protective housing 19 is maintained at a selected temperature. By maintaining the interior of the housing at a selected temperature, the chemical dispensing unit 12 may be used at locations where the ambient temperature may otherwise be too low for proper withdrawal of the liquid chemicals 20, 22 from the respective supply tanks T1, T2.

An outlet of each supply tank T1, T2 in the chemical dispensing unit 12 may be coupled to an inlet of a respective low pressure transfer pump 21. The low pressure transfer pumps 21 may be coupled at their respective discharges to an inlet of a respective applicator pump P1, P2. The outlet of each low pressure transfer pump 21 may be in pressure communication with an accumulator 23. The low pressure transfer pumps 21 and accumulators 23 maintain a minimum pressure in the inlet to each applicator pump P1, P2 so as to reduce the possibility of cavitation therein.

The applicator pumps P1, P2, may be, for example, positive displacement pumps such as vane type pumps, gear type pumps or axial screw type pumps which may include a rotary encoder or similar sensor to generate a signal corresponding to movement of each applicator pump P1, P2 and as a result corresponding to the actual volume of fluid moved by each applicator pump P1, P2. In some embodiments, one or more flow meters, e.g., as shown at 40, may be installed in each chemical delivery hose (described below) to autonomously measure volume flow. The applicator pumps P1, P2 may be rotated by an electric motor M. In one example embodiment one electric motor may rotate both applicator pumps P1, P2, however in the other embodiments there may be one motor for each respective pump. A conduit connecting each transfer pump 21 to a respective applicator pump P1, P2 may be thermally coupled to a respective heat exchanger HE1, HE2. The heat exchangers HE1, HE2 may be liquid-to-liquid heat exchangers and may be heated by liquid coolant from an engine ENG disposed in or on the protective housing 19, or on a separate part of the chemical dispensing unit 12. In such embodiments, waste heat from the engine ENG may be used to preheat the liquid chemicals 20, 22 to reduce the amount of power consumed by the respective applicator pumps P1, P2. The engine ENG may be used to drive a generator GEN or similar source of electric power for use by the chemical dispensing unit 12.

Discharge from each of the two applicator pumps P1, P2 may be conducted to another dry connect valve 14, wherein respective chemical delivery hoses 29 may conduct the discharged liquid chemicals 20, 22 to a spray gun 28.

In the present example embodiment, the chemical delivery hoses 29 may each include a plurality of heaters H, for example, electrically operated resistance heaters, disposed at spaced apart locations along the length of each chemical delivery hose 29. Each chemical spray hose 29 may have a temperature sensor 30 disposed therein proximate to each heater H.

A first pressure sensor 24 may be in pressure communication with the discharge side of each applicator pump P1, P2 to measure pressure of the chemical as it is being discharged into each chemical delivery hose 29. A second pressure sensor 26 may be in pressure communication with an interior of each chemical delivery hose 29 proximate the spray gun 28.

A central processor CPU, which may be implemented in any form such as and without limitation a microprocessor, programmable logic controller, floating programmable gate array or an application specific integrated circuit may accept as input signals from the temperature sensors 30 and the first 24 and second 26 pressure sensors. The central processor CPU may also accept as input measurements of volume of liquid pumped from each of the applicator pumps P1, P2. The central processor CPU may operate the motor(s) M and the heating elements H.

In the present example embodiment, the heating elements H may be operated by the CPU to maintain a temperature of the liquid chemical 20, 22 in each chemical delivery hose 29 at a temperature such that the respective viscosity of each chemical 20, 22 is at a selected value. By selecting a temperature for each liquid chemical to be maintained at a selected viscosity, a pumping rate of each liquid chemical 20, 22 through each respective chemical delivery hose 29 may be more precisely controllable. A relationship exists between viscosity of each liquid chemical 20, 22 and its temperature. For purposes of more precise control over the volume and/or mass flow rate of each liquid chemical 20, 22 through the respective chemical delivery hose 29, measurement of difference between fluid pressure at the first pressure sensors 24 and the second pressure sensors 26 may be calculated in the central processor CPU. In the present embodiment, pressure differences may be used by the central processor CPU to adjust the temperature measured at each of the temperature sensors 30 by operating respective ones of the heaters H so that a selected pressure difference is maintained during spray application of each of the liquid chemicals 20, 22. By adjusting temperature so that selected pressure differences are maintained, more precise control over respective flow rates of each liquid chemical 20, 22 may be maintained. The central processor CPU may also record with respect to time measurements of fluid mass and/or volume measured by measuring rotation of the applicator pumps P1, P2 as the liquid chemicals 20, 22 are sprayed during application.

In some embodiments, each supply tank T1, T2 in the chemical dispensing unit 12 may include a liquid level sensor 32, such an acoustic ranging sensor, capacitance sensor or any other sensor capable of measuring liquid level in the supply tanks T1, T2. Measurements of liquid level in each supply tank T1, T2 may be conducted to the central processor CPU. The central processor CPU may generate a warning indication or may provide a liquid level display to the system user so that when the supply tanks T1, T2 require refilling, the user may be advised of such condition.

In some embodiments, changes in liquid level in each supply tank T1, T2 may be used to calibrate the metering output of each applicator pump P1, P2. Because the volume of each supply tank T1, T2 is known, a total liquid volume removed from each supply tank T1, T2 may be calculated, e.g., in the central processor CPU using measurements from the liquid level sensors 32. Such known volume may be compared to the metered volume measured by each applicator pump P1, P2; differences between the pump measured volume and the liquid level-determined volume may be used by the CPU to recalibrate the metering signal from each applicator pump P1, P2.

While the example embodiment in FIG. 1 shows one set of chemical delivery hoses 29 and one spray gun 28, it will be appreciated by those skilled in the art that in other embodiments more than one set of pumps and/or more than one set of chemical delivery hoses and spray guns may be used.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus for simultaneously dispensing at least two liquids at preselected flow rates comprising:

a spray gun;

a first container containing a first liquid;

a second container containing a second liquid;

a first pump having an inlet in fluid communication with the first container, the first pump having an outlet;

a first pressure sensor in fluid communication with the outlet of the first pump;

a first heated hose having an inlet connected to the outlet of the first pump and an outlet connected to the spray gun;

a second pump having an inlet in fluid communication with the second container, the second pump having an outlet;

a second pressure sensor in fluid communication with the outlet of the second pump;

a second heated hose having an inlet connected to the outlet of the second pump and an outlet connected to the spray gun;

a third pressure sensor in fluid communication with the outlet of the first heated hose;

a fourth pressure sensor in fluid communication with the outlet of the second heated hose;

a first flow rate sensor in fluid communication with the outlet of the first heated hose;

a second flow rate sensor in fluid communication with the outlet of the second heated hose;

a processor connected to the first pump, the second pump, the first pressure sensor, the second pressure sensor, the third pressure sensor, the fourth pressure sensor, the first flow rate sensor, and the second flow rate sensor and configured to vary the output of the second pump in real time in response to signals from the pressure sensor, the first flow rate sensor and the second flow rate sensor.

2. The apparatus recited in claim 1 wherein at least one of the first and second flow rate sensors is responsive to volume flow rate.

3. The apparatus recited in claim 1 wherein at least one of the first and second flow rate sensors is responsive to mass flow rate.

4. The apparatus recited in claim 1 wherein the respective preselected flow rates are equal.

5. The apparatus recited in claim 1 wherein at least one of the first and second pumps is a positive displacement pump.

6. The apparatus recited in claim 5 wherein the positive displacement pump is a vane-type pump.

7. The apparatus recited in claim 5 wherein the positive displacement pump is a gear-type pump.

8. The apparatus recited in claim 5 wherein the positive displacement pump is an axial screw-type pump.

9. The apparatus recited in claim 5 wherein the positive displacement pump comprises a sensor configured to generate a signal corresponding to movement of the pump.

10. The apparatus recited in claim 9 wherein the sensor comprises a rotary encoder.

11. The apparatus recited in claim 1 further comprising at least one low-pressure transfer pump having an inlet in fluid communication with at least one of the first container and the second container and an outlet in fluid communication with at least one of the inlet of the first pump and the second pump.

12. The apparatus recited in claim 11 further comprising an accumulator in fluid communication with both the outlet of the at least one low-pressure transfer pump and the inlet of the at least one of the first pump and the second pump.

13. The apparatus recited in claim 1 wherein the processor comprises a microprocessor.

14. The apparatus recited in claim 1 wherein the processor comprises a programmable logic controller.

15. The apparatus recited in claim 1 wherein the processor comprises a floating programmable gate array.

16. The apparatus recited in claim 1 wherein the processor comprises an application-specific integrated circuit.

17. The apparatus recited in claim 1 further comprising:

a fluid delivery hose having an inlet at one end in fluid communication with the outlet of at least one of the first pump and an outlet at an opposing end thereof;

a first pressure sensor responsive to fluid pressure at the inlet of the fluid delivery hose; and a second pressure sensor responsive to fluid pressure at the outlet of the fluid delivery hose, the first and second pressure sensors in signal communication with the processor.

18. The apparatus recited in claim 17 wherein the fluid delivery hose is heated.

19. The apparatus recited in claim 18 further comprising at least one temperature sensor responsive to a temperature of fluid within the fluid delivery hose and in signal communication with the processor.

20. A method for simultaneously dispensing at least two liquids from a spray gun comprising:

operating a first pump having an inlet in fluid communication with a first container having a first liquid therein, the first pump having an outlet connected to the inlet of a first heated hose having an outlet connected to the spray gun;

operating a second pump having an inlet in fluid communication with a second container having a second liquid therein, the second pump having an outlet connected to the inlet of a second heated hose having an outlet connected to the spray gun;

measuring a first fluid pressure with a first pressure sensor in fluid communication with the outlet of the first pump;

measuring a second fluid pressure with a second pressure sensor in fluid communication with the outlet of the second pump;

measuring a third fluid pressure with a third pressure sensor in fluid communication with an outlet of the first heated hose;

measuring a fourth fluid pressure with a fourth pressure sensor in fluid communication with an outlet of the second heated hose;

measuring a flow rate of the first liquid from the first pump;

measuring a flow rate of the second liquid from the second pump; and controlling the second pump in real time in response to the measured fluid pressures, the measured flow rate of the first liquid from the first pump and the measured flow rate of the second liquid from the second pump.

* * * * *